United States Patent [19]

Stoesser et al.

[11] Patent Number: 4,906,395

[45] Date of Patent: Mar. 6, 1990

[54] DETERGENT PACKAGE FOR LAUNDERING CLOTHES

[75] Inventors: P. Richard Stoesser; Stephen W. Barr, both of Midland, Mich.

[73] Assignee: The Dow Chemical Company, Midland, Mich.

[21] Appl. No.: 808,778

[22] Filed: Dec. 13, 1985

[51] Int. Cl.[4] ..... C11D 17/00

[52] U.S. Cl. ..... 252/90; 206/459; 252/134; 252/174

[58] Field of Search ..... 252/90–92, 252/134, 174, 93; 436/162; 206/459, 807; 8/137

[56] References Cited

U.S. PATENT DOCUMENTS 1,843,234 2/1932 Karnes et al. ..... 206/459
3,263,892 8/1966 Danyi et al. ..... 206/459
3,770,641 11/1973 Cantor et al. ..... 252/90
4,269,722 5/1981 Joshi et al. ..... 252/90

FOREIGN PATENT DOCUMENTS 10106 2/1973 Japan .

*Primary Examiner*—Prince E. Willis

[57] ABSTRACT

A detergent package having a cap of a given volume is described.

The package has an indicator strip adapted to undergo a physical change upon contact with a sample of water. The physical change is visually perceptible and indicative of the amount of detergent necessary to effectively launder clothes in the water. The amount of detergent indicated by the indicator strip is expressed as a multiple of the volume of the cap.

The use of the package is also described.

1 Claim, 1 Drawing Sheet

DETERGENT PACKAGE FOR LAUNDERING CLOTHES

Presently employed home laundry detergents generally include amongst their ingredients both a sequestering agent and a surfactant. The function of the sequestering agent is to remove from the wash water the ions that are principally responsible for so called "hardness" in the water. These ions are principally calcium and magnesium. In any given detergent composition the proportion of sequestering agent in the composition is fixed by the manufacturer. It is therefore necessary to add sufficient detergent and therefore sufficient sequestering agent to the given volume of wash water in order to substantially completely remove from solution the hardness-producing ions. If these hardnessproducing ions are not removed they will adversely affect the cleaning performance of the detergent composition.

As is well-known, the function of the surfactant is to emulsify and thereby emulsify non-water soluble soil that is present on the clothes and on other material to be laundered.

The hardness of laundry water varies greatly throughout the world. In some parts of the world, wash water contains hardness of equal to or less than 90 parts per million (ppm) of hardness measured as calcium carbonate. On the other hand, in other parts of the world, water can be very hard and can have a hardness equal to or greater than 450 ppm of hardness. The typical housewife does not know the hardness of the water in which she washes. Furthermore, she has no easy method of determining the hardness of the wash water. It is, therefore, common practice among housewives to add to the wash water a greater amount of detergent than necessary to (a) substantially completely sequester all the hardness-producing ions and (b) emulsify all of the non-water soluble soil. Thus, the typical housewife can add up to twice the amount of detergent necessary to adequately clean the laundry.

It is, therefore, an object of the present invention to provide a package that results in the better cleaning of clothes with less detergent.

Another object is to provide a package that can be used to determine water hardness to indicate the amount of detergent necessary for cleaning clothes.

A further object of the present invention is to provide a detergent package that leads to the more economical use of detergent.

A still further object of the present invention is to provide an improved detergent package that will truly improve the value of packaged detergent.

Yet another object of the present invention is to provide an improved detergent package that will enhance the perceived value of packaged detergent.

Additional objects and advantages of the present invention will be apparent to those skilled in the art by reference to the following description and drawings wherein.

According to the broadest aspects of the present invention there is provided a detergent package which contains detergent for laundering clothes. The detergent package comprises a water impermeable container and an indicator. The water impermeable container has a removable cap which in turn has a given volume. An indicator strip is carried by the detergent package. The indicator strip is adapted to undergo a physical change upon contact with a sample of water. This physical change is visually perceptible and is indicative of the amount of detergent necessary to effectively launder clothes in the water from which the sample of water was obtained. The amount of detergent is indicated by the indicator strip. The amount of detergent is preferably expressed as a multiple of the volume of the cap, but could be expressed as a multiple of a standard liquid or dry measure.

According to another aspect of the present invention there is provided an improved method for laundering clothes. This improved method relies on the use of the improved detergent package of the present invention. In this improved method the housewife first contacts the indicator strip with the wash water. In response to the physical changes in the indicator strip the housewife selects that number of capfuls of detergent which are just sufficient to adequately clean the laundry.

Figure 1:
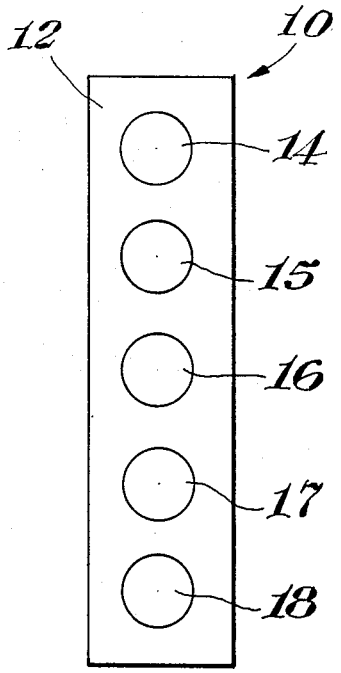
Fig. 1 (Prior art)
FIG. 1 shows a prior art hardness-indicator strip.
Figure 4:
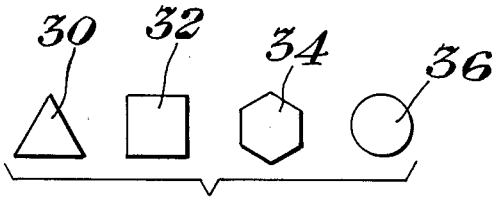
FIG. 4 shows alternate shapes which can be employed on an indicator strip in the present invention.

FIG. 1 shows a prior art indicator strip 10. The indicator strip 10 has a paper segment 12 and a plurality of dots such as the dots 14, 15, 16, 17 and 18. The term "dots" as used herein refers to any geometrical shapes and is not intended to be limited to circular configurations. The "dots" may have any of the shapes 30, 32, 34 and 36 shown in FIG. 4, or may have any other geometrical configuration. Prior to being contacted with water these dots 14, 15, 16, 17 and 18 are, in certain prior art embodiments, green. When contacted with water, none, some, or all of the dots will change color from green to pink in response to the amount of hardness in the water. If the water has less than 90 ppm of hardness all five dots will remain green. If the water has approximately 90 ppm of hardness one dot will turn from green to pink. If the tap water has approximately 180 ppm of hardness two dots will turn from green to pink. If the tap water has approximately 270 ppm of hardness three dots will turn from green to pink. If the tap water has approximately 360 ppm of hardness four dots will turn from green to pink. If the tap water has a hardness equal to or greater than about 420 ppm all five dots will turn pink. In the prior art, indicator strips such as the strip 10 are commonly employed with a sheet of paper giving the above-identified information. The chemical composition of each of the dots 14, 15, 16, 17 and 18 is somewhat different in order to effect the above-described color changes.

Figure 2:
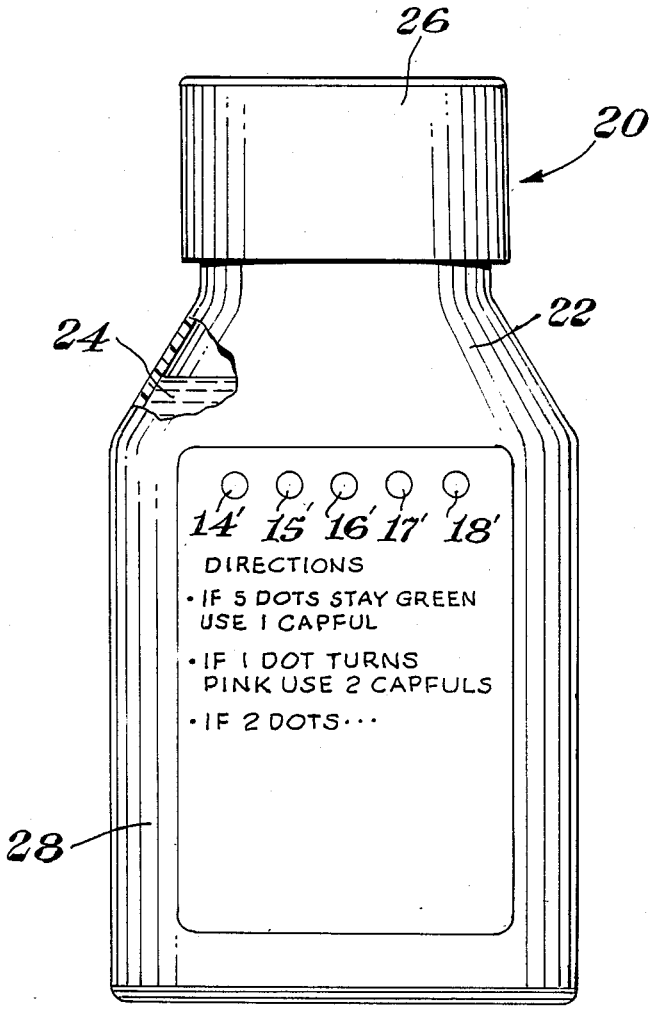
FIG. 2 shows a detergent package of the present invention wherein an indicator strip is carried by the label.

Referring now to FIG. 2, there is shown a detergent package 20 of the present invention. The detergent package 20 is especially useful for storing and dispensing detergent for use in a washtub such as a home washing machine. The washtub contains water which has calcium ions and magnesium ions. The package 20 comprises a container 22 having an open top. within the container 22 is a water-soluble detergent 24. The detergent 24 comprises a sequestering agent for calcium ions and for magnesium ions.

The package 20 has a cap 26 which closes the open top of the container 22. A single filling of the cap 26 consititutes one capful of detergent.

The package 20 also comprises a label 28. The label 28 is provided with dots 14', 15', 16', 17' and 18'. The dots 14', 15', 16', 17' and 18' have chemical compositions similar to the dots 14, 15, 16, 17 and 18 in the respect that dots 14', 15', 16', 17' and 18' will undergo a visibly perceptible color change in response to the amount of hardness in a water sample. The label 28 constitutes an indicator strip. When the label 28 is placed underneath tap water, none, some, or all of the dots 14', 15', 16', 17' and 18' turn from one color to another, the exact colors depending on the chemical composition selected for sensing water hardness. The label 28 directly converts the number of color changed dots to the number of capfuls of detergent sufficient for the sequestering agent to sequester substantially all the calcium and magnesium ions in the water in the washtub.

Figure 3:
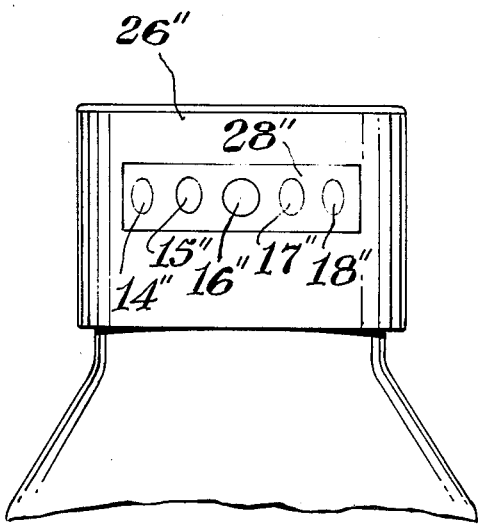
FIG. 3 shows an alternate detergent package of the present invention wherein an indicator strip is carried by the cap.

FIG. 3 shows an alternative embodiment of the present invention, wherein the label 28" carrying the dots 14', 15', 16', 17" and 18" is carried by the cap 26".

Although the indicator strip has been shown in two possible embodiments in FIG. 2 and 3, the present invention is not limited to these embodiments. The indicator strip can be carried by the detergent package in any suitable manner. For example, the indicator strip can be an integral part of a label carried by the container on any sidewall thereof or on the bottom thereof. The indicator strip could also be carried by the cap as a part of a label affixed to the top or side thereof on the outer or inner surfaces. Alternatively, the indicator strip could be removable affixed to the container or cap in any convenient manner.

The detergent 24 is a built detergent comprising sequestering agents for calcium and magnesium ions. Examples of suitable sequestering agents include ehtylenediaminetetraacetic acid tetrasodium salt sold under the trademark VERSENE; VERSENOL 120; any other VERSENE type sequestering agents; zeolites; phosphates, such as sodium tripolyphosphate, potassium tripolyphosphate, sodium and potassium tetrapolyphosphates, and sodium and potassium pyrophosphates; citrates; sodium silicates; sodium carbonates; nitrilotriacetic acid and salts; and tricarballylic acid salts. VERSENE and VERSENOL are trademarks of The DOW Chemical Company, and products sold under these trademarks are available from The DOW Chemical Company, Midland, Michigan.

The package of the present invention can be used with a wide variety of washtubs and varying volumes. However, the package of the present invention is most advantageously used with automatic washing machines. Automatic washing machines manufactured and sold in the United States of America have a standard-sized washtub. That standard-sized washtub is adapted to hold 60.5 liters (16 gallons) of water. In fact, over 90 percent of the automatic washtubs manufactured in the United States today have volumes of from 53 to 68 liters (14 to 18 gallons).

It would be readily understood that this invention is primarily concerned with adding to the wash water only that amount of sequestering agent just necessary to substantially remove all of the hardness-producing ions. However, clothes that are particularly dirty will require an amount of surfactant in addition to that added concurrently with the proper number of capfuls of detergent. When practicing the present invention it is recommeded to include on the label 28 a statement directing the housewife to use one extra capful or fraction thereof of detergent for particularly dirty clothes.

As previously stated, the detergents useful in the present invention include a sequestering agent and a surfactant. It is also common for detergents to include many other ingredients such as optical whiteners, diluents, processing aids, dyes and perfumes.

The invention may be better understood by reference to the following examples wherein all parts and percentages are by weight unless otherwise indicated. These examples are designed to teach those skilled in the art how to practice the invention and represent the best mode presently contemplated for carrying out the invention.

EXAMPLE 1

This example illustrates the production of a composition of matter useful as the dot 14' which changes color at approximately 50 ppm of hardness.

The following quantities of the following ingredients are combined as indicated.

| Item | Ingredient | Quantity (% by weight) |
|---|---|---|
| A | cyclohexylene dinitrilotetraacetic acid (CDTA) | 0.085 |
| B | tris(hydroxymethyl)aminomethane (TRIS) | 0.770 |
| C | cresolphthalein complexone, tetrasodium salt (Indicator) | 0.380 |
| D | starch | 0.040 |
| E | deionized water | 98.725 |

Items A, B, C, D and E were mixed to form an impregnating solution. Filter paper was soaked for about one minute in the impregnating solution, then blotted dry with clean filter paper and air dried or dried in an oven at 50° C. This impregnated filter paper is dot 14'. Dot 14' changes color from pink to violet when contacted with water containing approximately 50 ppm hardness.

EXAMPLE 2

This example illustrates the production of a composition that changes color when exposed to water containing 110 ppm of hardness.

Example 1 is repeated employing the following quantities of the same ingredients.

| Item | Ingredient | Quantity (% by weight) |
|---|---|---|
| A | CDTA | 0.135 |
| B | TRIS | 0.770 |
| C | Indicator | 0.380 |
| D | starch | 0.040 |
| E | deionized water | 98.675 |

Items A, B, C, D and E were mixed to form an impregnating solution and filter paper was impregnated therewith in the manner set forth in Example 1. The impregnated filter paper produced is dot 15'. Dot 15' changes color from pink to violet when contacted with water containing approximately 110 ppm hardness.

EXAMPLE 3

This example illustrates the production of a composition that changes color when exposed to water containing 200 ppm of hardness.

Example 2 is repeated employing the following quantities of the same ingredients.

| Item | Ingredient | Quantity (% by weight) |
|---|---|---|
| A | CDTA | 0.165 |
| B | TRIS | 0.770 |
| C | Indicator | 0.380 |
| D | starch | 0.040 |
| E | deionized water | 98.645 |

Items A, B, C, D and E were mixed to form an impregnating solution and filter paper was impregnated therewith in the manner set forth in Example 1. The impregnated filter paper produced is dot 16'. Dot 16' changes color from pink to violet when contacted with water containing approximately 200 ppm hardness.

EXAMPLE 4

This example illustrates the production of a composition that changes color when exposed to water containing 300 ppm of hardness.

Example 1 is repeated employing the following quantities of the same ingredients.

| Item | Ingredient | Quantity (% by weight) |
|---|---|---|
| A | CDTA | 0.242 |
| B | TRIS | 0.770 |
| C | Indicator | 0.380 |
| D | starch | 0.040 |
| E | deionized water | 98.568 |

Items A, B, C, D and E were mixed to form an impregnating solution and filter paper was impregnated therewith in the manner set forth in Example 1. The impregnated filter paper produced is dot 17'. Dot 17' changes color from pink to violet when contacted with water containing approximately 300 ppm hardness.

EXAMPLE 5

This example illustrates the production of a composition that changes color when exposed to water containing 400 ppm of hardness.

Example 1 is repeated employing the following quantities of the same ingredients.

| Item | Ingredient | Quantity (% by weight) |
|---|---|---|
| A | CDTA | 0.363 |
| B | TRIS | 0.770 |
| C | Indicator | 0.380 |
| D | starch | 0.040 |
| E | deionized water | 98.447 |

Items A, B, C, D and E were mixed to form an impregnating solution and filter paper was impregnated therewith in the manner set forth in Example 1. The impregnated filter paper produced is dot 18". Dot 18' changes colors from pink to violet when contacted with water containing approximately 400 ppm hardness.

Although the invention has been described in detail with reference to certain specific embodiments, it will be understood that variations can be made without departing from the scope of the invention as described above and as claimed below.

What is claimed is:

1. A detergent package containing detergent for laundering clothes, said detergent package comprising:

A. a water-impermeable container having a removable cap having a given volume; and B. an indicator strip carried by the container, said indicator strip being adapted to undergo a physical change upon contact with a sample of water, said physical change being visually perceptible and indicative of the amount of detergent necessary to effectively launder clothes in water from which the sample of water was obtained, said indicator strip comprising:

a first dot adapted to undergo a visually perceptible physical change upon contact with a sample of water containing at least 50 ppm hardness, said first dot comprising paper impregnated with a solution comprising 0.085% by weight cyclohexylene dinitrilotetraacetic acid, 0.770% by weight tris(hydroxymethyl) aminomethane, 0.380% by weight cresolphthalein complexone tetrasodium salt, 0.040% by weight starch and 98.725% by weight deionized water;

a second dot adapted to undergo a visually perceptible physical change upon contact with a sample of water containing at least 110 ppm hardness, said second dot comprising paper impregnated with a solution comprising 0.135% by weight cyclohexylene dinitrilotetraacetic acid, 0.770% by weight tris(hydroxymethyl)aminomethane, 0.380% by weight cresolphthalein complexone tetrasodium salt, 0.040% by weight starch and 98.675% by weight deionized water;

a third dot adapted to undergo a visually perceptible physical change upon contact with a sample of water containing at least 200 ppm hardness, said third dot comprising paper impregnated with a solution comprising 0.165% by weight cyclohexylene dinitriolotetraacetic acid, 0.770% by weight tris(hydroxymethyl)aminomethane, aminomethane, 0.380% by weight cresolphthalein complexone tetrasodium salt, 0.040% by weight starch and 98.645% by weight deionized water;

a fourth dot adapted to undergo a visually perceptible physical change upon contact with a sample of water containing at least 300 ppm hardness, said fourth dot comprising paper impregnated with a solution comprising 0.242% by weight cyclohexylene dinitrilotetraacetic acid, 0.770% by weight tris(hydroxymethyl)aminomethane, 0.380% by weight cresolphthalein complexone tetrasodium salt, 0.040% by weight starch and 98.568% by weight deionized water;

a fifth dot adapted to undergo a visually perceptible physical change upon contact with a sample of water containing at least 400 ppm hardness, said fifth dot comprising paper impregnated with a solution comprising 0.363% by weight cyclohexylene dinitriolotetraacetic acid, 0.770% by weight tris(hydroxymethyl) aminomethane, 0.380% by weight cresolphthalein complexone tetrasodium salt, 0.040% by weight starch and 98.447% by weight deionized water;

wherein the amount of detergent indicated by the indicator strip is expressed as a multiple of the volume of the cap.

* * * * *

UNITED STATES PATENT AND TRADEMARK OFFICE

CERTIFICATE OF CORRECTION

PATENT NO. : 4,906,395

DATED : March 6, 1990

INVENTOR(S) : Paul S. Stoesser and Steven W. Barr

It is certified that error appears in the above-identified patent and that said Letters Patent is hereby corrected as shown below:

Column 1, line 17, "hardnessproducing" should correctly appear as --hardness-producing--.

Column 2, line 62, "within" should correctly appear as --Within--.

Column 3, line 20, "14', 15', 16'," should correctly appear as --14", 15", 16",--.

Column 3, line 50, "and" should correctly appear as --of--.

Column 5, line 1, "Example 2" should correctly appear as --Example 1--.

Column 5, line 59, "18"" should correctly appear as --18'--.

Column 6, line 40, delete the word "aminomethane,".

Signed and Sealed this

Second Day of April, 1991

*Attest:*

*Attesting Officer*

HARRY F. MANBECK, JR.

*Commissioner of Patents and Trademarks*